US009725148B2

(12) United States Patent
Kinoshita

(10) Patent No.: US 9,725,148 B2
(45) Date of Patent: Aug. 8, 2017

(54) JET PROPELLED WATERCRAFT

(71) Applicant: YAMAHA HATSUDOKI KABUSHIKI KAISHA, Iwata-shi, Shizuoka (JP)

(72) Inventor: Yoshimasa Kinoshita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 100 days.

(21) Appl. No.: 14/487,125

(22) Filed: Sep. 16, 2014

(65) Prior Publication Data

US 2015/0118069 A1 Apr. 30, 2015

(30) Foreign Application Priority Data

Oct. 31, 2013 (JP) ..... 2013-226878

(51) Int. Cl.

| | |
|---|---|
| ***B63H 11/11*** | (2006.01) |
| ***B63H 11/08*** | (2006.01) |
| *B63H 21/21* | (2006.01) |
| *B63H 21/14* | (2006.01) |

(52) U.S. Cl.

CPC ..... *B63H 11/11* (2013.01); *B63H 11/08* (2013.01); *B63H 21/14* (2013.01); *B63H 21/21* (2013.01); *B63H 2011/081* (2013.01)

(58) Field of Classification Search

CPC B63H 21/21; B63H 2021/216; B63H 11/107; B63H 11/11

USPC ..... 701/21; 440/1

See application file for complete search history.

(56) References Cited

U.S. PATENT DOCUMENTS

| | | | | |
|---|---|---|---|---|
| 5,474,370 | A * | 12/1995 | Ravndal | B60T 8/173 303/113.5 |
| 7,775,844 | B2 * | 8/2010 | St-Pierre | B63H 11/113 440/40 |
| 8,177,594 | B2 * | 5/2012 | Dagenais | B63H 11/11 441/1 |
| 8,256,851 | B2 * | 9/2012 | Pelosse | B60T 7/20 303/123 |

* cited by examiner

*Primary Examiner* — Andrew Polay

(74) *Attorney, Agent, or Firm* — Keating and Bennett, LLP

(57) ABSTRACT

A jet propelled watercraft includes a vessel body, a jet propulsion mechanism, a bucket, and a controller. The jet propulsion mechanism is configured to propel the vessel body. The controller is configured and programmed to control a thrust of the jet propulsion mechanism to propel the vessel body. The bucket is configured to move to a retracted position spaced away from the jet of water ejected from the jet propulsion mechanism and a jet receiving position to receive the jet of water ejected from the jet propulsion mechanism. The controller is configured and programmed to change an increase rate of the thrust in accordance with a forward speed of the vessel body until the thrust is increased to a predetermined value after the bucket has been moved from the retracted position to the jet receiving position.

6 Claims, 5 Drawing Sheets

JET PROPELLED WATERCRAFT

CROSS-REFERENCE TO RELATED APPLICATIONS

The present application claims priority under 35 U.S.C. §119 to Japanese Patent Application No. 2013-226878, filed on Oct. 31, 2013. The entire disclosure of Japanese Patent Application No. 2013-226878 is hereby incorporated herein by reference.

BACKGROUND OF THE INVENTION

1. Field of the Invention

The present invention relates to a jet propelled watercraft.

2. Description of the Related Art

To stabilize behavior of a vessel body when reducing the speed of a jet propelled watercraft, a method has been disclosed that, when the forward speed of the vessel is greater than a predetermined speed, thrust to reduce the speed of the vessel body is further reduced in comparison with when the forward speed of the vessel body is less than or equal to the predetermined speed (see U.S. Pat. No. 8,177,594).

However, according to the method described in U.S. Pat. No. 8,177,594, thrust is set in accordance with the forward speed at the start of reducing the speed. Hence, it is difficult to simultaneously implement a prompt speed reduction and a stabilized behavior of the vessel body. Specifically, where the predetermined speed is set to be somewhat high, the behavior of the vessel body is likely to be unstable when the forward speed is slightly less than the predetermined speed. This is because, in such a condition, the behavior of the vessel body easily becomes unstable, although the thrust is large.

By contrast, where the predetermined speed is set to be somewhat low, a prompt speed reduction cannot be implemented when the forward speed is slightly greater than the predetermined speed. This is because, in such a condition, the behavior of the vessel body is unlikely to be unstable, but thrust is small.

SUMMARY OF THE INVENTION

Preferred embodiments of the present invention have been conceived in view of the aforementioned situation. A preferred embodiment of the present invention provides a jet propelled watercraft that achieves both a prompt speed reduction and a stabilized behavior of a vessel body during the speed reduction.

A jet propelled watercraft according to a preferred embodiment of the present invention includes a vessel body, a jet propulsion mechanism, a controller, and a bucket. The jet propulsion mechanism is configured to propel the vessel body. The controller is configured and programmed to control a thrust of the jet propulsion mechanism to propel the vessel body. The bucket is configured to move to a retracted position spaced away from the jet of water ejected from the jet propulsion mechanism and a jet receiving position to receive the jet of water ejected from the jet propulsion mechanism. The controller is configured and programmed to change an increase rate of the thrust in accordance with a forward speed of the vessel body until the thrust is increased to a predetermined value after the bucket has been moved from the retracted position to the jet receiving position.

According to preferred embodiments of the jet propelled watercraft described below, a jet propelled watercraft is provided that achieves both a prompt speed reduction and a stabilized behavior of a vessel body during the speed reduction.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
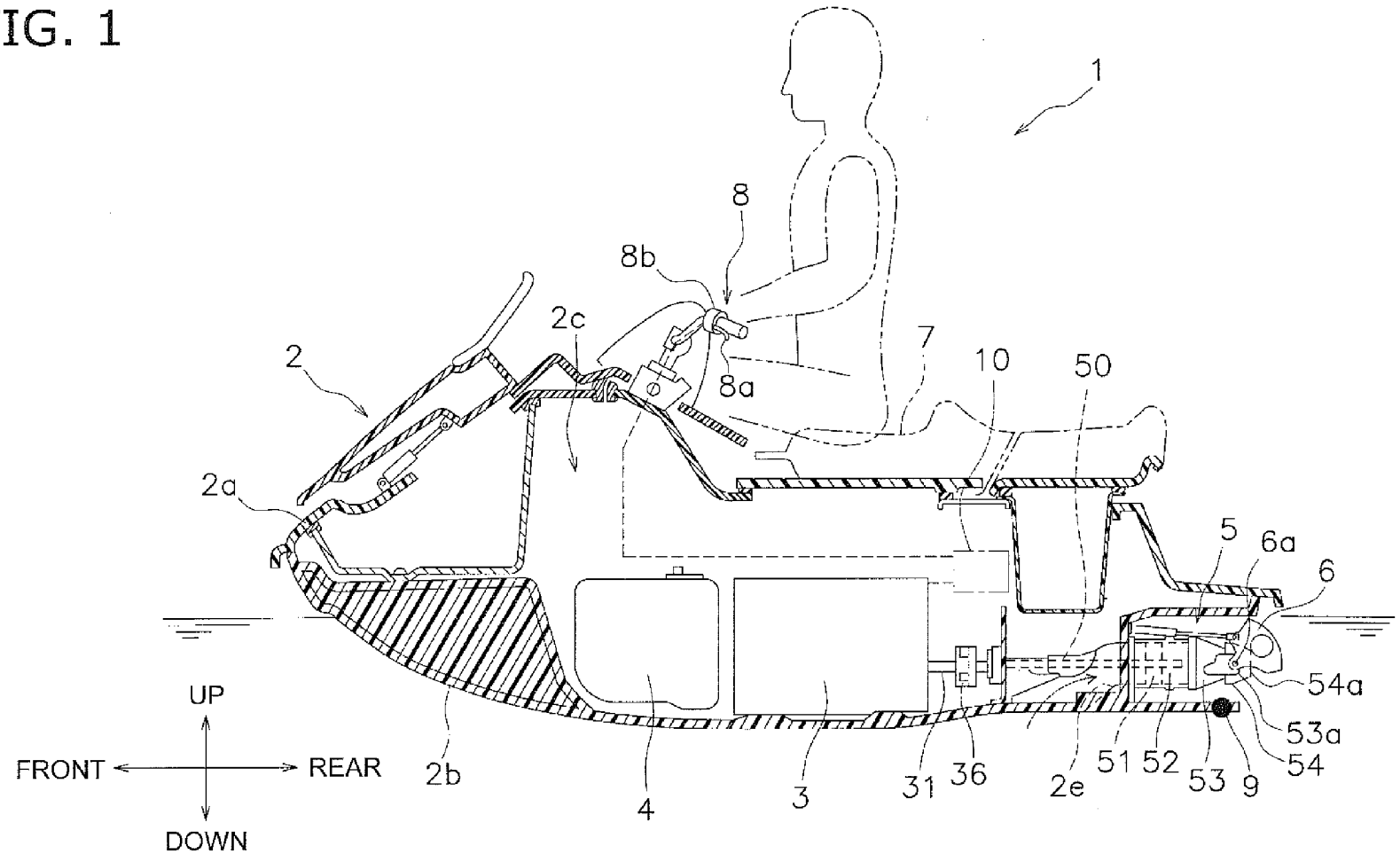
FIG. 1 is a cross-sectional view of a schematic structure of a jet propelled watercraft according to a preferred embodiment of the present invention.

With reference to the drawings, explanation will be hereinafter made for a schematic structure of a jet propelled watercraft 1 according to preferred embodiments of the present invention. FIG. 1 is a cross-sectional view of the schematic structure of the jet propelled watercraft 1 according to a preferred embodiment. In the following explanation, the terms "front", "rear", "right" and "left" are defined with reference to the point of view of a vessel operator seated on a seat 7.

The jet propelled watercraft 1 preferably is so-called a personal watercraft (PWC), for example. The jet propelled watercraft 1 includes a vessel body 2, an engine 3, a fuel tank 4, a jet propulsion mechanism 5, a bucket 6, the seat 7, a steering handle 8, a speed sensor 9, and a controller 10.

The vessel body 2 includes a deck 2*a* and a hull 2*b*. An engine compartment 2*c* is provided inside the vessel body 2. The engine compartment 2*c* accommodates the engine 3, the fuel tank 4 and so forth. The engine 3 includes a crankshaft 31 extending in the back-and-forth direction.

The jet propulsion mechanism 5 is configured to generate thrust to propel the vessel body 2 by a driving force from the engine 3. The jet propulsion mechanism 5 is configured to suck in and eject water that surrounds the vessel body 2. The jet propulsion mechanism 5 includes an impeller shaft 50, an impeller 51, an impeller housing 52, a jet nozzle 53, and a steering nozzle 54.

The impeller shaft 50 is disposed so as to extend rearward from the engine compartment 2*c*. The front portion of the impeller shaft 50 is coupled to the crankshaft 31 through a coupling member 36. The rear portion of the impeller shaft 50 extends into the impeller housing 52 through a water suction member 2*e* of the vessel body 2. The impeller housing 52 is connected to the rear portion of the water suction member 2*e*.

The impeller 51 is attached to the rear portion of the impeller shaft 50. The impeller 51 is disposed inside the impeller housing 52. The impeller 51 is configured to be rotated together with the impeller shaft 50 and suck water into the impeller housing 52 through the water suction member 2*e*. The impeller 51 is configured to rearwardly eject the sucked in water out of the jet nozzle 53. The jet nozzle 53 is disposed rearward of the impeller housing 52. A support bracket 53*a* to support the bucket 6 is fixed to the jet nozzle 53.

The steering nozzle 54 is disposed rearward of the jet nozzle 53. The steering nozzle 54 includes a jet port 54*a*. A jet of water that propels the vessel body 2 is ejected from the jet port 54*a* rearward. The steering nozzle 54 is mounted so as to be pivotable right and left. The steering nozzle 54 is configured to switch the ejection direction of the jet of water between right and left in response to the operation of the steering handle 8. The steering nozzle 54 is preferably configured to switch the ejection direction between up and down in response to the operation of a trim adjustor switch mounted to the steering handle 8.

The bucket 6 is disposed rearward of the jet propulsion mechanism 5. The bucket 6 is supported by the support bracket 53*a*, while being pivotable up and down about a pivot shaft 6*a* extending right and left. The bucket 6 is configured to move to a position spaced away from the jet of water ejected from the jet port 54*a* (hereinafter referred to as "a retracted position") and a position to receive the jet of water ejected from the jet port 54*a* (hereinafter referred to as "a jet receiving position"). In the present preferred embodiment, the jet receiving position is a concept that includes: a position in which thrust does not act on the vessel body 2 (hereinafter referred to as "a neutral position", see FIG. 1); and a position in which rearward thrust acts on the vessel body 2 (hereinafter referred to as "a rearward thrust position"). When the bucket 6 is located in the retracted position, the jet of water mainly flows rearward and the vessel body 2 is thus moved forward. Therefore, the retracted position is expressed as a position in which forward thrust acts on the vessel body 2 (hereinafter referred to as "a forward thrust position"). On the other hand, when the bucket 6 is located in the neutral position, the forward thrust and the rearward thrust are cancelled out. Therefore, when the vessel body 2 is in a state of not being moved, the unmoved state is maintained. When the bucket 6 is located in the rearward thrust position, the jet of water mainly flows forward. When the bucket 6 is located in the rearward thrust position and the vessel body 2 is moving forward, the vessel body 2 is reduced in its speed. On the other hand, when the bucket 6 is located in the rearward thrust position and the vessel body 2 is not presently being moved, the vessel body 2 begins to move backwards.

The seat 7 is attached to the deck 2*a*. The seat 7 is disposed over the engine 3. The steering handle 8 is disposed forward of the seat 7. The steering handle 8 is an operating member configured to steer the vessel body 2. The steering handle 8 is equipped with a throttle operating member 8*a* and a shift operating member 8*b*.

The throttle operating member 8*a* is an operating member configured to regulate the throttle opening degree of the engine 3. A vessel operator regulates the thrust of the jet propulsion mechanism 5 by changing the operating amount of the throttle operating member 8*a*.

The shift operating member 8*b* is movable to a forward shift position, a rearward shift position, and a neutral shift position. When the shift operating member 8*b* is switched into the forward shift position, the bucket 6 is configured to be moved to the retracted position. When the shift operating member 8*b* is switched into either the neutral shift position or the rearward shift position, the bucket 6 is configured to be moved to the jet receiving position (the neutral position or the rearward thrust position).

The speed sensor 9 is attached to the hull 2*b* and disposed under the jet nozzle 53. In the present preferred embodiment, a paddle turbine is used as the speed sensor 9. It should be noted that for the speed sensor 9, it is possible to use a rotation speed sensor configured to measure the rotation speed of the crankshaft 31 of the engine 3, a receiver configured to receive a navigation signal from a navigation satellite of GNSS (Global Navigation Satellite System) or so forth.

The controller 10 includes a computer including a CPU, a memory and so forth. The controller 10 is configured and programmed to control the thrust of the jet propulsion mechanism 5 to propel the vessel body 2.

Figure 2:
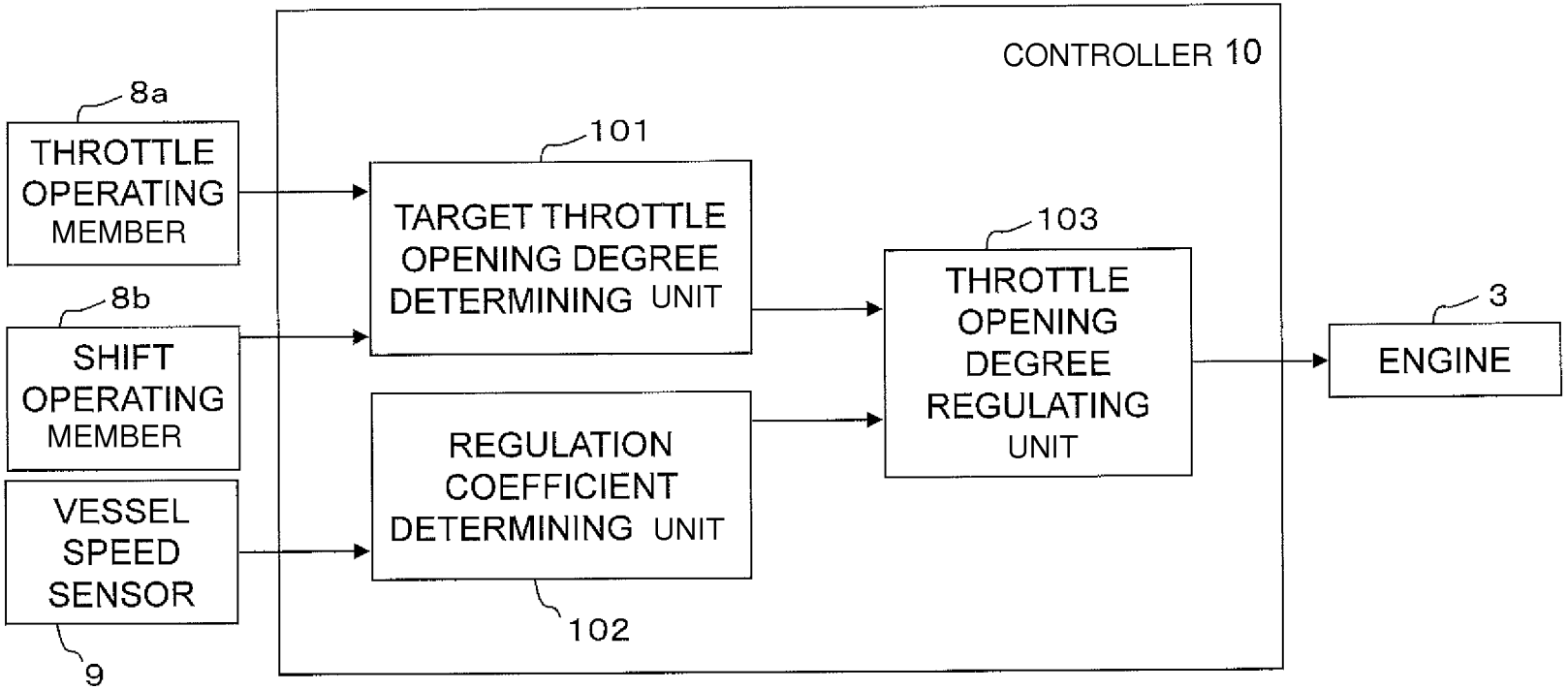
FIG. 2 is a block diagram representing a configuration of a controller according to a preferred embodiment of the present invention.

FIG. 2 is a block diagram representing a configuration of the controller 10. FIGS. 3A to 3G are charts respectively exemplifying a transition in the operating amount V of the throttle operating member 8*a*, a transition in the position of the shift operating member 8*b*, a transition in the target throttle opening degree TG, a transition in the forward speed S, a transition of the regulation coefficient R, a transition of the throttle opening degree TH, and a transition of the thrust P.

As shown in FIG. 2, the controller 10 includes a target throttle opening degree determining unit 101, a regulation coefficient determining unit 102, and a throttle opening degree regulating unit 103.

Figure 3A:
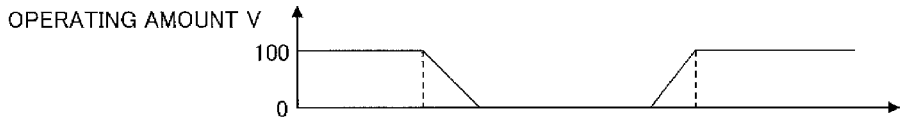
FIG. 3A is a chart exemplifying a transition in an operating amount of a throttle operating member.
Figure 3B:
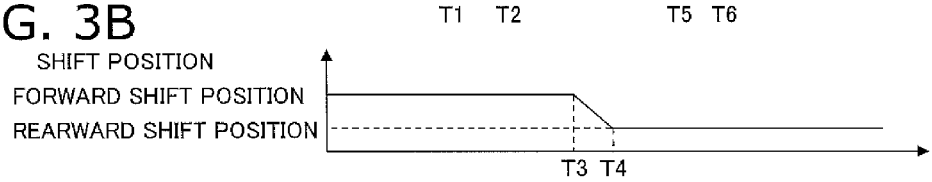
FIG. 3B is a chart exemplifying a transition in a position of a shift operating member.

The target throttle opening degree determining unit 101 is configured to detect the operating amount V of the throttle operating member 8*a* shown in FIG. 3A. In the example of FIG. 3A, the operating amount V is reduced from 100 (maximum value) to 0 (minimum value) in a period from a clock time T1 to a clock time T2, and is then increased from 0 to 100 in a period from a clock time T5 to a clock time T6. It should be noted that the operating amount V is a value that is variable in response to the operation by the vessel operator. The target throttle opening degree determining unit 101 is configured to detect the position of the shift operating member 8*b* shown in FIG. 3B. In the example of FIG. 3B, the shift operating member 8*b* is moved from the forward shift position to the rearward shift position in a period from a clock time T3 to a clock time T4. In conjunction, the bucket 6 (see FIG. 1) is moved from the retracted position to the jet receiving position.

Figure 3C:
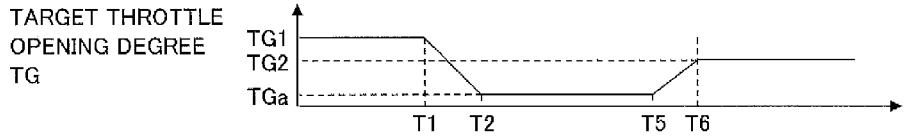
FIG. 3C is a chart exemplifying a transition of a target throttle opening degree.

The target throttle opening degree determining unit 101 is configured and programmed to determine the target throttle opening degree TG shown in FIG. 3C based on the operating amount V of the throttle operating member 8*a* and the position of the shift operating member 8*b*. The target throttle opening degree TG is the maximum value of the throttle opening degree TH required to obtain the thrust desired by the vessel operator. The target throttle opening degree determining unit 101 is configured and programmed to determine the target throttle opening degree TG regardless of the magnitude of the forward speed S. In the example of FIG. 3C, the target throttle opening degree TG is reduced from a first target opening degree TG1 to an idling opening degree TGa in a period from the clock time T1 to the clock time T2, and is then increased from the idling opening degree TGa to a second target opening degree TG2 in a period from the clock time T5 to the clock time T6. The idling opening degree TGa is set to be a value required to cause the engine 3 to idle. Because the operating amount V of the throttle operating member 8*a* is increased to 100 as shown in FIG. 3E, the first target opening degree TG1 is set as the maximum value of the throttle opening degree TH where the bucket 6 is located in the retracted position, whereas the second target opening degree TG2 is set as the maximum value of the throttle opening degree TH where the bucket 6 is located in the jet receiving position in the example of FIG. 3C.

The target throttle opening degree determining unit 101 is configured and programmed to output the determined target throttle opening degree TG to the throttle opening degree regulating unit 103.

Figure 3D:
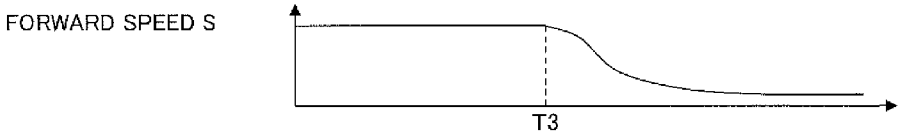
FIG. 3D is a chart exemplifying a transition of the forward speed.
Figure 3E:
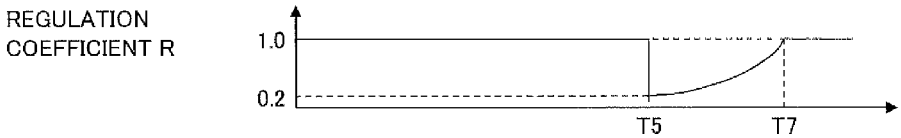
FIG. 3E is a chart exemplifying a transition of a regulation coefficient.

The regulation coefficient determining unit 102 is configured and programmed to detect the forward speed S shown in FIG. 3D. The forward speed S is gradually reduced at, and after, the clock time T3 when the bucket 6 begins to be moved toward the jet receiving position. As shown in FIG. 3E, the regulation coefficient determining unit 102 is configured and programmed to determine the regulation coefficient R in accordance with the forward speed S in a period from the clock time T5 to a clock time T7, and configured and programmed to keep the regulation coefficient R at 1.0 (maximum value) at, and before, the clock time T5 and at, and after, the clock time T7. The clock time T5 is a clock time when the target throttle opening degree TG begins to be increased from the idling opening degree TGa to the second target opening degree TG2 after the bucket 6 has been moved to the jet receiving position. The clock time T7 is a clock time when the target throttle opening degree TG reaches the second target opening degree TG2.

Figure 4:
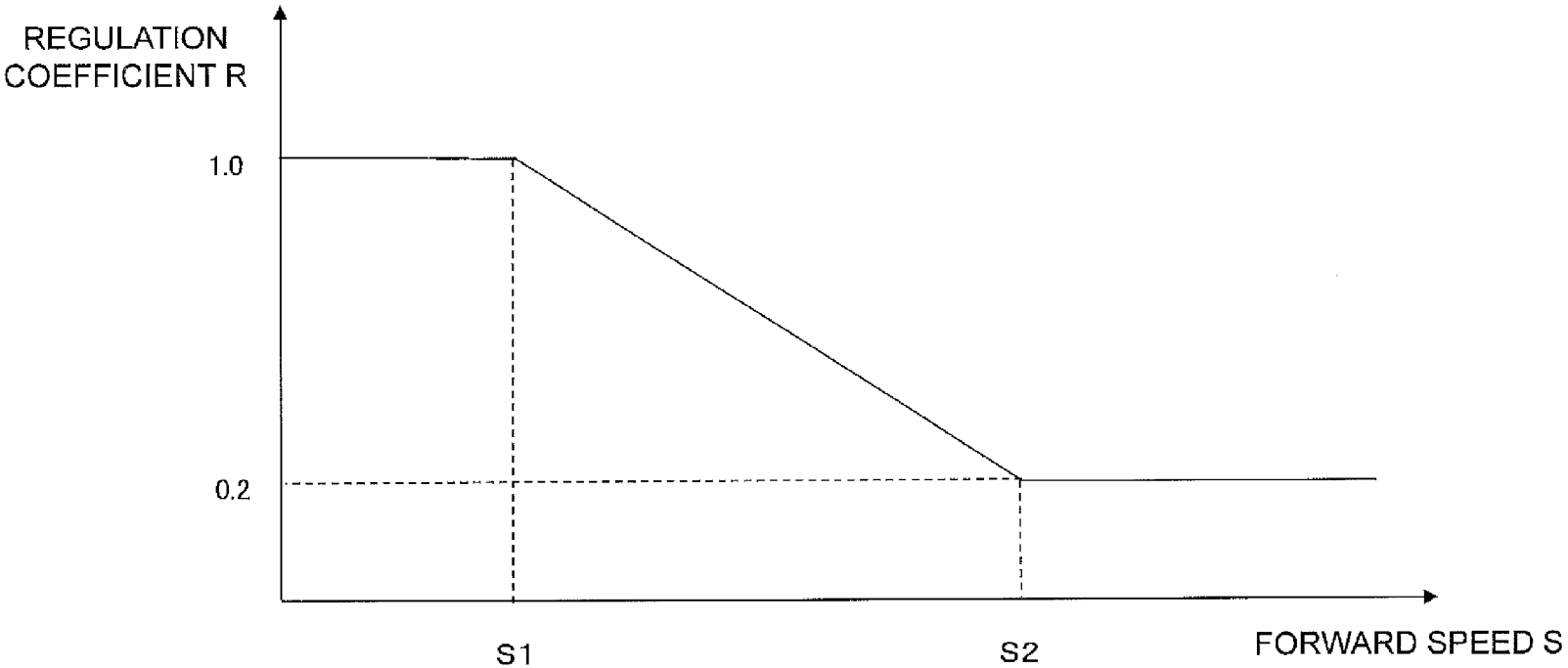
FIG. 4 is a chart exemplifying a relationship between the forward speed and the regulation coefficient.

FIG. 4 represents a chart exemplifying a relationship between the forward speed S and the regulation coefficient R. As shown in FIG. 4, when the forward speed S is greater than a lower limit S1 and less than an upper limit S2, the regulation coefficient determining unit 102 is configured and programmed to reduce the regulation coefficient R in accordance with increase in the forward speed S. On the other hand, when the forward speed S is less than or equal to the lower limit S1, the regulation coefficient determining unit 102 is configured and programmed to fix the regulation coefficient R at 1.0 (maximum value). Yet, on the other hand, when the forward speed S is greater than or equal to the upper limit S2, the regulation coefficient determining unit 102 is configured and programmed to fix the regulation coefficient Rat 0.2 (minimum value). It should be noted that the minimum value (herein set to be 0.2) of the regulation coefficient R can be arbitrarily set.

The regulation coefficient determining unit 102 is configured and programmed to output the determined regulation coefficient R to the throttle opening degree regulating unit 103.

Figure 3F:
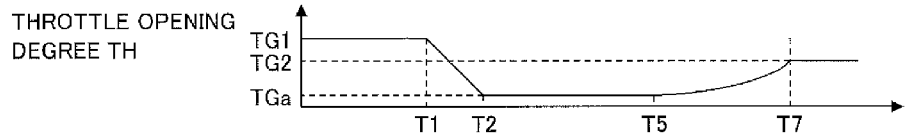
FIG. 3F is a chart exemplifying a transition of a throttle opening degree.

The throttle opening degree regulating unit 103 is configured and programmed to calculate the throttle opening degree TH shown in FIG. 3F by multiplying the target throttle opening degree TG and the regulation coefficient R. In the example of FIG. 3F, the throttle opening degree TH is reduced from the first target opening degree TG1 to the idling opening degree TGa in a period from the clock time T1 to the clock time T2, and is then kept at the idling opening degree TGa in a period from the clock time T2 to the clock time T5. Thereafter, the throttle opening degree TH is increased from the idling opening degree TGa to the second target opening degree TG2 in accordance with a reduction in the forward speed S in a period from the clock time T5 to the clock time T7, and is then kept at the second target opening degree TG2.

Figure 3G:
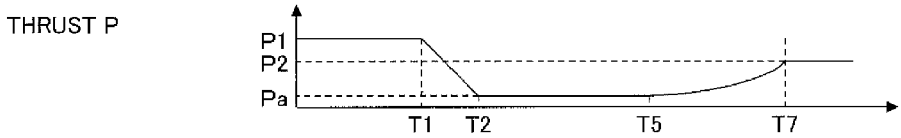
FIG. 3G is a chart exemplifying a transition of the thrust.

The throttle opening degree regulating unit 103 is configured and programmed to control the driving force of the engine 3 by outputting the calculated throttle opening degree TH to the engine 3. As a result, the rotation speed of the impeller 51 is regulated, and as shown in FIG. 3G, the thrust P of the jet propulsion mechanism 5 is regulated. In the example shown in FIG. 3G, the thrust P is reduced from a first thrust P1 to an idling thrust Pa in a period from the clock time T1 to the clock time T2, and is then kept at the idling thrust Pa in a period from the clock time T2 to the clock time T5. Thereafter, the thrust P is increased from the idling thrust Pa to a second thrust P2 in accordance with a reduction in the forward speed S in a period from the clock time T5 to the clock time T7, and is then kept at the second thrust P2.

Thus, the controller 10 is configured and programmed to change the increase rate of the thrust P in accordance with the forward speed S until the thrust P is increased to the second thrust P2 (an exemplary predetermined value) after the bucket 6 has been moved from the retracted position to the jet receiving position (i.e., in a period from the clock time T5 to the clock time T7). Thus, the speed of the vessel body 2 is reduced with the necessary and sufficient thrust P in a period from the clock time T5 to the clock time T7. Hence, the vessel body 2 is promptly reduced in its speed while being stabilized in its behavior.

The exemplary preferred embodiments of the present invention have been described above. However, the present invention is not limited to the aforementioned exemplary preferred embodiments, and a variety of changes can be herein made without departing from the scope of the present invention.

Figure 5:
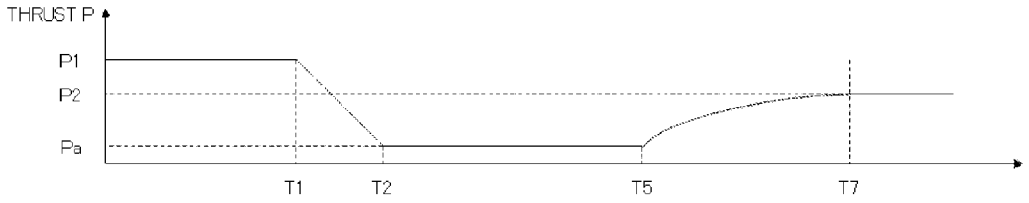
FIG. 5 is another chart exemplifying a transition of the thrust.

In the aforementioned exemplary preferred embodiments, the controller 10 is preferably configured and programmed to gradually increase the increase rate of the thrust P by gradually increasing the regulation coefficient R in accordance with a reduction in the forward speed S until the thrust P is increased to the second thrust P2. However, until the thrust P is increased to the second thrust P2, the controller 10 may be configured and programmed to gradually reduce the increase rate of the thrust P in accordance with the reduction in the forward speed S, as shown in FIG. 5, or alternatively, may be configured and programmed to keep the increase rate constant.

In the aforementioned exemplary preferred embodiments, the controller 10 is preferably configured and programmed to determine the regulation coefficient R in accordance with the chart shown in FIG. 4. However, the relationship between the forward speed S and the regulation coefficient R can be arbitrarily set.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propelled watercraft comprising:

a vessel body;

a jet propulsion mechanism configured to propel the vessel body;

a controller configured and programmed to control a thrust of the jet propulsion mechanism to propel the vessel body; and a bucket configured to move to a retracted position spaced away from a jet of water ejected from the jet propulsion mechanism and to a jet receiving position to receive the jet of water ejected from the jet propulsion mechanism; wherein the controller is configured and programmed to increase the thrust until the thrust is increased to a predetermined value after the bucket has been moved from the retracted position to the jet receiving position;

the controller is configured and programmed to increase the thrust at a rate that is changing in accordance with a forward speed of the vessel body; and the controller is configured and programmed to control the thrust using a throttle opening degree that is calculated by multiplying a target throttle opening degree and a regulation coefficient.

2. The jet propelled watercraft according to claim 1, wherein the controller is configured and programmed to increase the rate in accordance with a reduction in the forward speed until the thrust is increased to the predetermined value.

3. The jet propelled watercraft according to claim 1, wherein the controller is configured and programmed to reduce the rate in accordance with a reduction in the forward speed until the thrust is increased to the predetermined value.

4. The jet propelled watercraft according to claim 1, further comprising:

an engine configured to drive the jet propulsion mechanism; and a throttle operating member configured to regulate the target throttle opening degree of the engine; wherein the controller is configured and programmed to set the predetermined value in accordance with an operating amount of the throttle operating member.

5. The jet propelled watercraft according to claim 4, wherein the controller is configured and programmed to determine the predetermined value regardless of the forward speed at which the bucket has been moved from the retracted position to the jet receiving position.

6. The jet propelled watercraft according to claim 1, further comprising:

an engine configured to drive the jet propulsion mechanism, the engine including a crankshaft; wherein the jet propulsion mechanism includes an impeller shaft coupled to the crankshaft and an impeller attached to the impeller shaft; and the controller is configured and programmed to control the thrust by regulating a rotation speed of the impeller.

* * * * *